United States Patent [19]

Smith

[11] Patent Number: 4,511,243

[45] Date of Patent: Apr. 16, 1985

[54] TIME TO COMPLETION INTERACTION FOR A COPIER

[75] Inventor: Craig A. Smith, Pittsford, N.Y.

[73] Assignee: Xerox Corporation, Stamford, Conn.

[21] Appl. No.: 485,352

[22] Filed: Apr. 15, 1983

[51] Int. Cl.[3] ..... G03G 15/00

[52] U.S. Cl. ..... 355/14 CU

[58] Field of Search ..... 355/3 R, 3 SH, 14 C, 355/14 CU; 235/132 R, 132 A, 132 E

[56] References Cited

U.S. PATENT DOCUMENTS

| | | | |
|---|---|---|---|
| 4,128,756 | 12/1978 | Nagano et al. | 355/14 C UX |
| 4,218,129 | 8/1980 | Ishimoto et al. | 355/14 SH |
| 4,253,760 | 3/1981 | Tsuda et al. | 355/14 C UX |
| 4,398,819 | 8/1983 | Schron | 355/14 C UX |

FOREIGN PATENT DOCUMENTS 56-74173 11/1982 Japan .

*Primary Examiner*—A. C. Prescott

*Attorney, Agent, or Firm*—Bernard A. Chiama

[57] ABSTRACT

An arrangement for continuously monitoring the time to completion of a programmed reproduction run for a copier by utilizing the counters in a document handling apparatus and exiting the copier either to a sorting arrangement or finisher. Signals generated in accordance with the number of copies required to realize the run are applied to signals indicative of time to produce a single copy, whether simplex or duplex, and the resultant signal is applied to a duplexing or a countdown monitoring indication of time to completion.

4 Claims, 2 Drawing Figures

TIME TO COMPLETION INTERACTION FOR A COPIER

Figure 1:
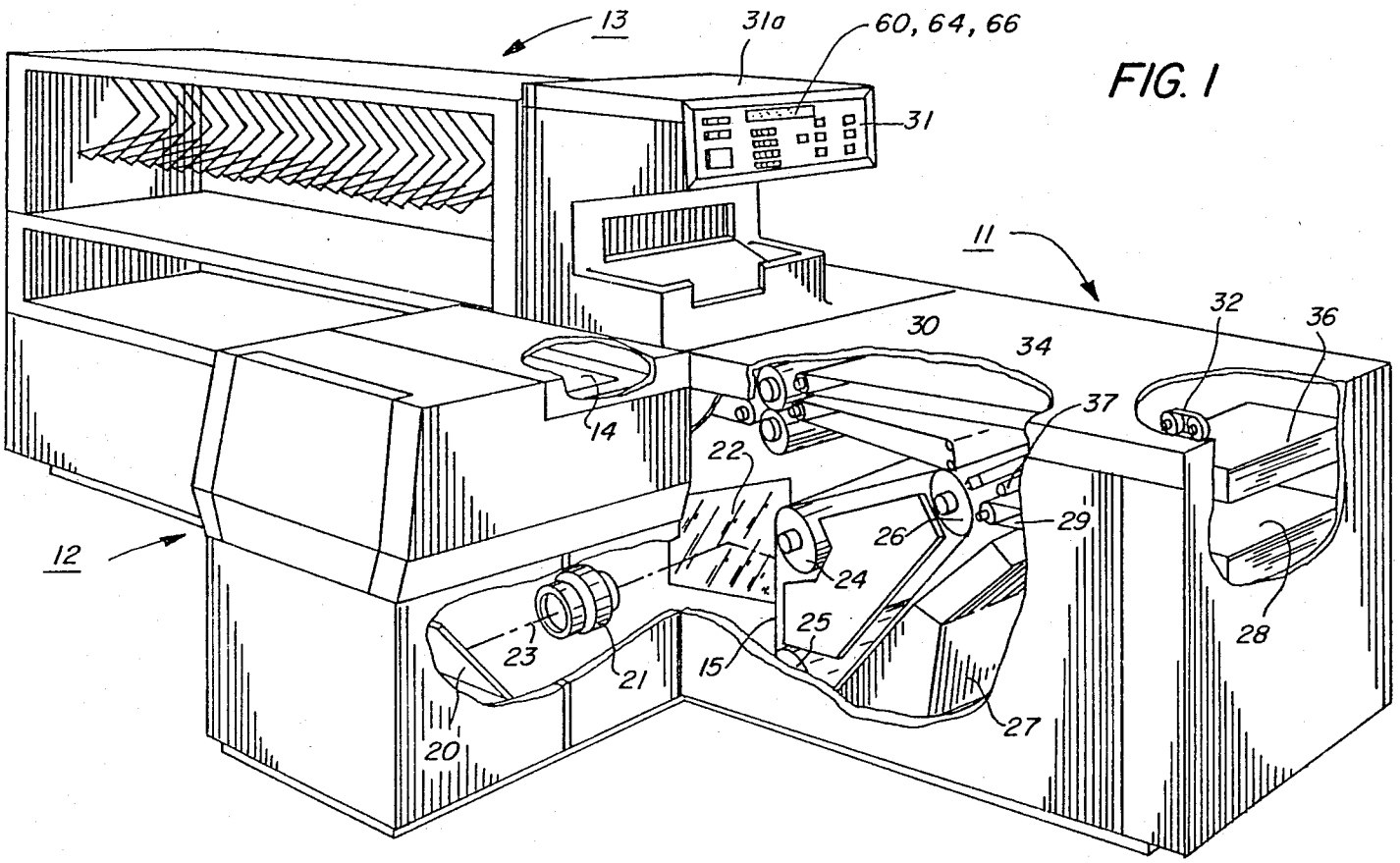

This invention relates to automatic electrostatographic duplicating machines and particularly to the improvement wherein an operator will be provided with an ongoing indication of copy sheets to be completed in terms of time to completion.

With the advent of high speed electrostatographic duplicating machines, the preferred use has been for reproduction runs of long duration, say runs lasting one or more hours and involving thousands of copy sheets. The time element is compounded considerably when the production run involves the making of duplex or double-sided copy sheets with or without some form of sheet binding such as stapling. Some duplicating machines include in their system an automatic document handling apparatus, a copy sheet processor which may be provided with two or more copy sheet supply stacks and attendant paper paths, and a sorting system having sorter modes of 25 or more collating bins. In combination with or as a substitute for the sorting system, there may be provided a stapling apparatus which, in turn, may include an arrangement for removing large quantities of stapled copy sets thereby maintaining a high level of throughput.

Heretofore, in the use of such reproduction systems and for long periods of time, the operator was, so to speak, chained to the machine until the run was completed. The relatively high rate of productivity for which the machine is capable is not entirely realized because of the loss of productivity due to the babysitting time spent by the operator. In the alternative, some operators, perhaps most in this situation, will return to their work area to perform their primary functions and leave the machine unattended. At periodic times, they will visit the machine and check upon its condition as to completion, such checking involving making mental computations, which are very inaccurate, of the approximate time remaining for the completion of the run. Such computations may involve estimating the time to produce a single-sided copy, then a double-sided copy, then to collect the copy sheets in sets, then the collection of many copy sets, and so on, and so on. In practice, such activities of the operator results in many disruptive trips to the machine area in order to check upon the condition of the programmed run. In many situations, one of those time periods before a machine check is made, and more often the last time, the operator may become more casual and even tardy resulting in the machine having completed its production run and having been standing in its OFF condition for a considerable non-productive time period. In this situation, more often than not, a number of other operators may be standing by waiting for the tardy operator to clear the machine. In any event, the operator is not making maximum use of the machine's productivity.

The present invention is directed to avoid the situations described above which result in the unnecessary diminution of total productivity of a duplicating machine and operator. In the arrangement of the present invention, one or more display devices and attendant connections are devised which interconnects the microprocessor(s) in the duplicating machine with the various copy sheet sensor/counters, document sheet sensor/counters, and the machine production timing system. The arrangement is such that the count of the number of document sheets to be copied, the selection of either simplex or duplex mode, the number of the programmed sets to be copied, the selection of either stapled or sorted copy sets, the first copy out time, and the cycle time for the processing of a single copy on one side of a sheet is integrated and computed to the actual time to or of completion and the remaining time for the completion of the reproduction run. The display is arranged to indicate the time remaining by providing a count down as the run is in progress, or on command or the time at which the job will be done as when needed. An alarm device in the form of a flashing light or audible vibration producer may be connected to the circuitry as a final indication that a run has been completed. Other utility may be envisioned by virtue of this arrangement, such as, jobs may be interrupted for other jobs, work planning may be enhanced and, there is an abundance of assurance for the next operator waiting in line for initiating job runs.

Therefore, it is the principal object of this invention to incorporate in the control system of an automatic duplicating machine, a time to or of completion indication which will provide an operator a continuous assessment of the time remaining in which a programmed reproduction run is to be in progress, or when the run will be completed.

It is another object of the present invention to increase the total productivity of an automatic duplicating machine/operator function by freeing the operator for other duties while a long reproduction run is in progress.

Figure 2:
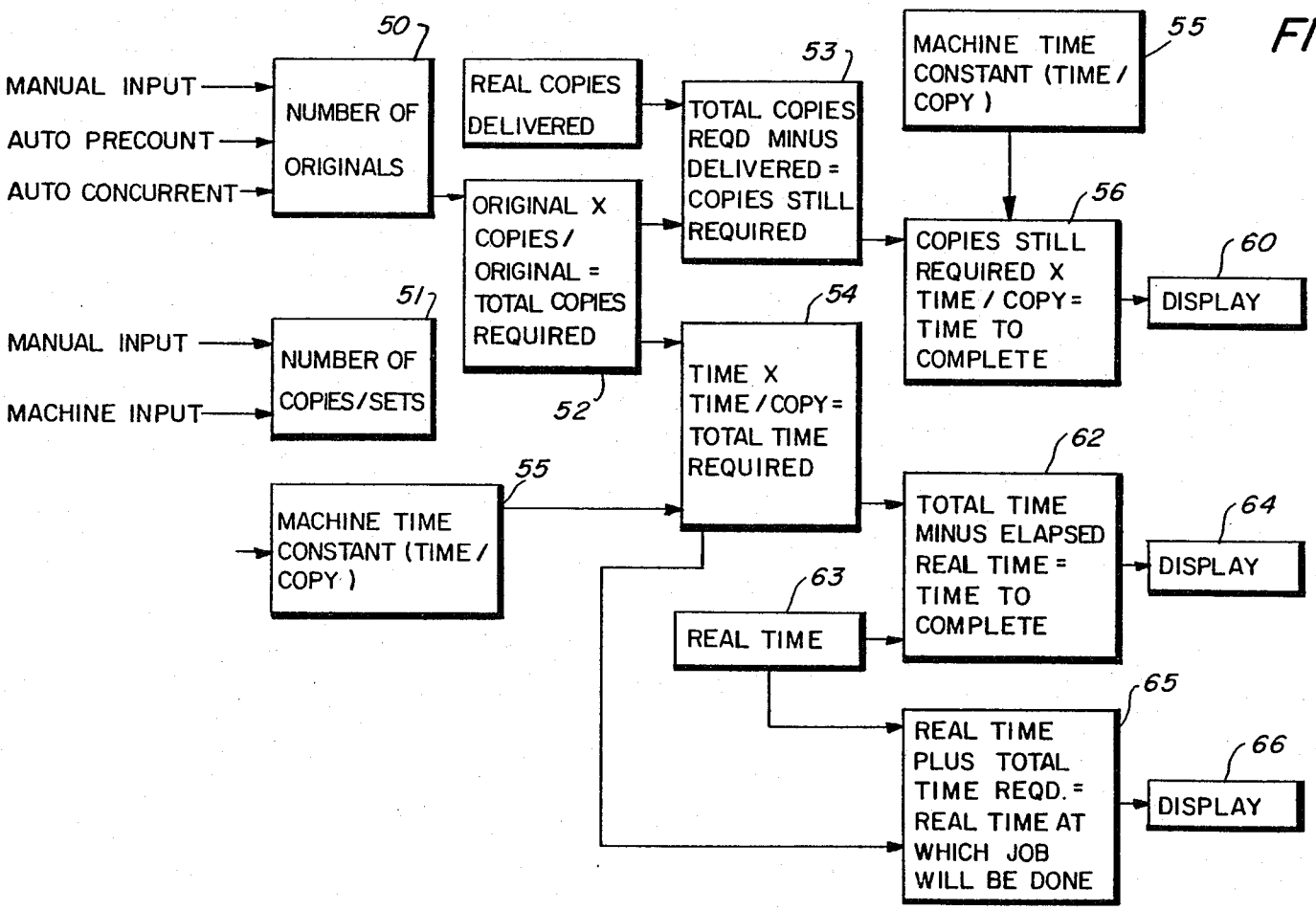

These and other objects of the present invention will become more apparent upon considering the following description taken in conjunction with the accompanying drawings wherein:

FIG. 1 is a perspective view of a duplicating system incorporating an automatic document handling apparatus, a copy sheet processor and sorting modules to which the present invention is applied; and FIG. 2 is a block diagram of an implementation of the present invention as applied to the machine shown in FIG. 1.

For a general understanding of an automatic electrostatographic duplicating machine to which the present invention may be incorporated, reference is made to FIG. 1 wherein components of a typical electrostatographic printing machine are illustrated. The printing system is preferably of the xerographic type as one including a xerographic processor 11, a document handling apparatus 12, and a sorter arrangement 13. Preferably, the printing system 11, 12 and 13 is the commercial, highly sophisticated embodiment of the Xerox machine model 9500 which utilizes flash, full frame exposure, for very high speed production. Document sheet handling and exposure, image processing and copy sheet transport/handling are under control by a machine programmer and are effected in timed sequence in conjunction with the machine clock system, and in accordance with the program an operator has preset in the machine. Further details in this regard are not necessary since the Xerox 9500 Duplicator operates in this manner and is well known. Details of the timing relationships and devices, the programmer, and related structure and events are described in U.S. Pat. Nos. 3,790,270; 3,796,486; and 3,917,396, commonly assigned and which are incorporated by reference.

As in all xerographic systems, a light image of an original to be reproduced, or an electronic facsimile thereof is projected onto the sensitized surface of a xerographic photosensitive surface to form an electrostatic latent image thereon. Thereafter, the latent image is developed with toner material to form a xerographic powder image corresponding to the latent image on the photosensitive surface. The powder image is then electrostatically transferred to a record material such as a sheet or web of paper or the like to which it may be fused by a fusing device whereby the powder image is caused to adhere permanently to the surface of the record material.

The xerographic processor 11 is arranged as a self-contained unit having all of its processing stations located in a unitary enclosure or cabinet. The processor includes an exposure station at which a conventional document to be reproduced is positioned on a glass platen 14 for projection onto a photosensitive surface in the form of a xerographic belt 15. The document or set of individual documents is selectively transported by the document feed apparatus 12 including a transport belt from the beginning of the set of sequenced documents in the apparatus to the platen for exposure and then returned on completion of the exposure until the entire stack has been copied, at which time the document set handling cycle may be repeated indefinitely as described in U.S. Pat. No. 3,829,082 entitled "Automatic Document Handler" and commonly assigned with the present invention.

Imaging light rays from the document which is flash illuminated by suitable lamps are projected by first mirror 20 and a projection lens 21 and another mirror 22 onto the xerographic belt 15 at the focal plane for the lens 21 along a path indicated by dotted lines 23.

The xerographic belt 15 is mounted for movement around three parallel arranged rollers 24, 25, and 26 suitably mounted in the frame of processor 11. The belt is continuously driven by a suitable motor (not shown) and at an appropriate speed. The exposure of the belt to the imaging light rays from the document discharges the photoconductive layer in the area struck by light whereby there remains on the belt an electrostatic image corresponding to the light image projected from the document. As the belt continues its movement, the electrostatic latent image passes a developing station at which there is positioned a developer apparatus 27 for developing the electrostatic latent image. After development, the powdered image is moved to an image transfer station whereat record material or sheets of paper just previously separated from a stack of sheets 28 and transported by a conveyor 29 to the transfer station is held against the surface of the belt to receive the developed powder image therefrom. The sheet is moved in synchronism with the movement of the belt during transfer of the developed image. After transfer, the sheet of paper is conveyed to a fusing station where a fuser device 30 is positioned to receive the sheet of paper for fusing the powder thereon. After fusing, the sheet is transported selectively to a catch tray T, the sorter 13, or finisher (not shown) or the like, or alternatively, transported back into the processor for duplexing, if so desired.

The reproduction system 11, 12, 13 is under control of a programmer 31 which permits an operator various options: to turn the entire system ON or OFF; to program the reproduction system for a desired number of reproductions to be made of each original document sheet; or for a desired number of collated copy sets; to select one of many different copy reduction sizes; and to select whether simplex or duplex copies are to be made. If the duplex copying mode is selected, each sheet of copy paper bearing an image and which has passed through the fusing apparatus 30 is transported to an auxiliary sheet feeding apparatus 32 by way of a transport 34. The feeding apparatus includes a sheet tray 36 which stores the one-sided copy sheets being until such appropriate time as determined by the programmer 31, the apparatus 32 commences transporting the stored sheets by way of a conveyor 37 which again presents the sheets to the xerographic belt 15 for permitting the transfer of developed images thereon to the second side of the sheets. The duplex copies are again transported to the fusing apparatus whereat the second sided images are fixed. The present invention also contemplates that duplex copies may be produced in a single pass through a copy processor rather than by the dual pass system described above.

Further details of the processing devices and stations in the printer system are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein.

In accordance with the present invention, the electrostatographic duplicating machine 11, 12 and 13 exemplifying a variety of high speed duplicating systems with flexible and sophisticated features and options to automatically and conveniently process and manipulate copies or copy sets by varied selective methods or sequences, for the purpose of receiving copies in any of numerous desired quantities, formats, enhancements, and arrangements, is adapted to be converted to copying document material or the like with many convenient and automatic control features and much versatility. The resulting apparatus provides the full compliment of processing and manipulating features for copying from document sheets and document sets.

The present invention contemplates the use of document counters in an automatic or semi-automatic document handling apparatus which are arranged to count the number of documents in the apparatus to be copied in a reproduction run. However, in the broad sense, the present invention is also applicable to the manual application of documents upon an exposure platen. This counting may be accomplished either by automatic precounting as the document sheets are slewed just prior to copying or concurrently as the documents are being handled during actual copying. The invention also contemplates the use of counters in the copy paper supply/feeders and along the copy paper transport path which includes the sorting modules in the duplicating system. In conjunction with the machine clock system from which the first copy out time and time to process a single side image on one side of a copy sheet can be computed, signals produced by the above referred counters are utilized to compute the time required to complete the reproduction run. Furthermore, the time may be displayed on a digital clock from the signals generated during the computations as real time, or as time to or of completion. Such activation of the display means may be arranged as ongoing continuous indications, where pertinent, or on request.

Examples of various patents teaching conventional document handlers, copy processors, and control systems therefor, including document path switches and counters, and copy sheet counters are U.S. Pat. Nos. 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344, 4,284,270; and 4,330,197. Conventional simple software instructions in a copier's conventional microprocessor logic circuitry and software of document handler and copier control functions and logic, as taught by the above and other patents and various commercial copiers, are well known and preferred. However, it will be appreciated that the document handling functions, copy processing, and controls described herein may be alternatively conventionally incorporated into a duplicating system or copier utilizing any other suitable or known simple software or hard wired logic systems, switch controllers, etc. Such software for functions described herein may vary depending on the particular microprocessor or microcomputer system utilized, of course, but will be already available to or readily programmable by those skilled in the art without experimentation from the descriptions provided herein.

The control of all of the exemplary sheet handling systems disclosed herein may be accomplished by conventionally activating them by signals from the controller in response to simple programmed commands and switch inputs from the copier console selected by the operator, such as selecting the number of copies, selecting simplex or duplex copying, selecting whether the documents are simplex or duplex, etc. These signals may conventionally actuate conventional electrical solenoid or cam controlled sheet deflector fingers and drive motors or their clutches in the selected steps or sequences as programmed. Conventional sheet path sensors or switches and bail bars, connected to the controller, may be utilized for counting and keeping track of the positions of documents and copy sheets, as is well known in the art, and taught in the above and other patents and products. Known precollation copying systems utilize such conventional microprocessor control circuitry and connecting switches for counting the number of document sheets as they are recirculated, counting the number of completed document set circulations, and thereby controlling the operation of the document and copy sheet feeders and inverters, etc.

All references cited herein, and their references, are incorporated by reference herein for appropriate teachings of additional or alternative details, features and/or technical background.

An implementation of the present invention is illustrated in FIG. 2 which depicts in block form the interconnections between the various components of the reproduction system 11, 12, 13. The programmer 31 is provided with operator control buttons and displays for permitting the programming of a reproduction run. Some of the control buttons are in the form of a keyboard through which the operator selects the number of copies to be made, in the alternative, the number of copy sets to be made and formed as sets in the sorter 13. As shown in FIG. 2, the block 50 depicts the number of originals to be copied which may be determined by a counter in the document handling apparatus 12.

As previously stated with respect to the foregoing cited patents, many commercial and patented copiers are provided with document handling devices which slew document sheets at high speed before copying the same for the purpose of counting the number of document sheets. In the alternative, such counting of document sheets may be provided concurrently during actual copying thereof. Still another alternative is the direct manual use of the platen for the copier wherein the operator manually applies and removes individual document sheets relative to the platen. In any event, the block 50 denotes the count of document sheets which is arrived at by manual input, auto precount or auto concurrent count. A signal is generated in accordance with this count.

The block 51 depicts another count number indicative of the number of copies per set which is required in the document handling apparatus after the same has slewed the document sheets during counting. Some copiers may provide operator buttons so as to permit this entry into the system. This count number generates another signal which combines with the signal attributed to the block 50 to produce a signal indicative of the total number of copy sheets to be produced for the programmed run. This total number is equal to the number of originals times the number of copies per original and is depicted in block 52.

The signal generated in block 52 as a result of the determination of the total number of copy sheets to be produced is directed to two blocks for further processing. In the first block, herein labeled 53, the total number signal is manipulated by another signal which is generated as being indicative of copies delivered up to a particular time. This latter signal may be derived by a sensor/counter located in the sorter modules to count copy sheets as they leave the processor 11 and enter the sorter 13. As a result of this manipulation, a signal is generated in the block 53 indicative of the copy sheets yet to be delivered. The to be delivered signal is derived as an equivalent to the arithmetical manipulation of total copies to be produced minus copies delivered.

The second block, herein labeled block 54, to which the total copies required signal from the block 52 is applied generates a signal indicative of the total time required to produce copies. In order to derive this latter signal, still another signal is applied to the block 54 by way of the machine clock system as depicted by the block 55. By virtue of the machine timing scheme, the first copy out time and a constant time per copy are determined and integrated and a signal is generated in accordance therewith. This integrated signal is applied to the block 54 to be manipulated with the total copies required signal from the block 52 to produce in the block 54 the signal indicative of the total time required to produce copies. As will be seen in FIG. 2 relative to the block 54, total copies required times the time per copy equals total time required.

Each of the signals generated in the blocks 53, 54 respectively, are utilized to effect the production of a signal indicative of the time to complete remaining to complete the production run. In other words, two such signals are generated and in different final paths. In the first path, the copies still required signal in the block 53, is conducted to a block 56 wherein the signal is manipulated with the signal from the block 55 which, as previously discussed, is generated from the machine clock system in terms of the first copy out time and the constant time to produce a single copy. The result of this manipulation produces a signal denoting the time to complete the run. The final signal is conducted to a display 60 in terms of real clock time, and as shown in FIG. 1, may be mounted on the console for the programmer 31. Preferably, the display 60 is in the form of a digital clock arranged to indicate a countdown of the seconds, or minutes and hours remaining to complete the production run.

In the second path, the signal in the block 54, which is indicative of the total time required, is conducted to the block 62 and is combined with a signal from a real time device 63, such as a conventional clock, to generate a time to complete signal. As shown in FIG. 2, the total time required signal from block 54 is combined with the real time signal from the device 63 as in the equivalent to the arithmetical expression: total time required minus elapsed time equals time to complete. The time to complete signal may be conducted to a second display 64 as an integrated signal in addition to the signal being directed to the display 60 from the block 56. On the other hand, the display 64 and the information shown thereon may replace the display 60 and the type of information displayed thereon. As another alternative, in the event it is desired that real time be displaced at which time a job will be completed, the signal from the block 54 may be combined with the signal from the real time block 63 and integrated in block 65. A third display 66 connected to the block 65 may depict the actual real time a job will be completed.

In operation, when the operator places a number of document sheets in the document handling apparatus 12 and presets a program of a particular reproduction run in the programmer 31, such for example, presets the number of copy sets to be produced and whether the copies are to be simplex or duplex and selects the use of the sorter 13, actuation of the machine to commence operation will automatically display in the display 60 the time that is required to complete that particular run. As copies are being made, the display will count down the minutes/hours remaining to complete time run continuously. The operator may merely observe the remaining time and may leave the area until such time has elapsed when the run has terminated. By virtue of this indication of time, the operator may pursue other tasks in order to maintain productivity during operator occupation.

From the foregoing it will be appreciated that an arrangement has been devised which will permit the use of a high speed printing machine for relatively long periods of time without the attendance of an operator until such time as the run has actually been completed. It will also be appreciated that the arrangement comprises components which are utilized in most sophisticated copies/duplicators presently on the market and/or patented. Use is had of the sensor/counting devices found in automatic document handling apparatus, sorters and the copy sheet paths in copy sheet processors, and taken in conjunction with the machine logic clock system. Signals produced by these components are manipulated in accordance with the foregoing description to provide the operator with a continuous indication of the count down of time remaining in which to complete a reproduction run.

While the invention has been described with reference to the structure disclosed, it is not confined to the details set forth, but is intended to cover such modifications or changes as may come within the scope of the following claims.

I claim:

1. The method of providing a continuous ongoing time to or of completion indication in regard to a programmed reproduction run in an electrostatographic printing system having a copy sheet processor including a machine clock system adapted to provide a signal indicative of the constant time to produce a single copy during the run and the copy sheets exiting the processor, comprising the steps of:

generating a signal indicative of the total number of copies to be produced during the run from the number of originals supplied by an operator and the number of copies programmed for the run, generating a signal indicative of the total time required to produce the programmed run from the application of the signal indicating the constant time to produce a single copy to said signal indicating the total number of copies to be produced, continuously modifying said total time signal as copies are being produced by a signal from a real time device thereby providing a continuous ongoing time to completion of the reproduction run, and displaying said continuously modified signal in a display device as a countdown time to or of completion for the programmed run.

2. The method of providing a continuous ongoing time to or of completion indication in regard to a programmed reproduction run in an electrostatographic printing system having a copy sheet processor including a machine clock system adapted to provide a signal indicative of the constant time to produce a single copy during the run and the copy sheets exiting the processor, comprising the steps of:

generating a signal indicative of the total number of copies to be produced during the run from the number of originals and the number of copies programmed for the run, generating a signal indicative of the total time required to produce the programmed run from the application of the signal indicating the constant time to produce a single copy to said signal indicating the total number of copies to be produced, continuously modifying said total time signal as copies are being produced by a signal from a real time device thereby providing a continuous ongoing time to completion of the reproduction run, and displaying said continuously modified signal in a display device on operator command as a time to or of completion for the programmed run.

3. The method of providing a continuous ongoing time to or of completion indication in regard to a programmed reproduction run in an electrostatographic printing system having a copy sheet processor including a machine clock system adapted to provide a signal indicative of the constant time to produce a single copy, an automatic document handling apparatus and counting devices arranged to count the number of document sheets in a document set to be copied in the apparatus during the run and the copy sheets exiting the processor, comprising the steps of:

generating a signal indicative of the total number of copies to be produced during the run from the number of originals counted by one of the counters and the number of copies per document set as programmed for the run, generating a signal indicative of the total time required to produce the programmed run from the application of the signal indicating the constant time to produce a single copy to said signal indicating the total number of copies to be produced, continuously modifying said total time signal as copies are being produced by a signal from a real time device thereby providing a continuous ongoing time to completion of the reproduction run, and displaying said continuously modified signal in a display device as a countdown time to or of completion for the programmed run.

4. The method of providing a continuous ongoing time to or of completion indication in regard to a programmed reproduction run in an electrostatographic printing system having a copy sheet processor including a machine clock system adapted to provide a signal indicative of the constant time to produce a single copy, an automatic document handling apparatus and counting devices arranged to count the number of document sheets in a document set to be copied in the apparatus during the run and the copy sheets exiting the processor, comprising the steps of:

generating a signal indicative of the total number of copies to be produced during the run from the number of originals counted by one of the counters and the number of copies per document set as programmed for the run, generating a signal indicative of the difference between the total number of copies to be produced and those exiting the processor thereby indicating the number of copies still required for the programmed run, modifying said signal indicative of the number of copies still required to produce the programmed run with the application of the signal thereby indicating the constant time to produce a single copy, thereby providing a continuous ongoing time to completion of the reproduction run, and displaying said modified signal in a display device as a countdown time to completion for the programmed run.

* * * * *